United States Patent [19]

Nakamura et al.

[11] Patent Number: 4,901,115

[45] Date of Patent: Feb. 13, 1990

[54] TONER CONCENTRATION CONTROL DEVICE FOR A DEVELOPING APPARATUS

[75] Inventors: Minoru Nakamura, Toyohashi; Masahide Ueda; Toru Matsui, both of Toyokawa, all of Japan

[73] Assignee: Minolta Camera Kabushiki Kaisha, Osaka, Japan

[21] Appl. No.: 110,792

[22] Filed: Oct. 21, 1987

[30] Foreign Application Priority Data

Oct. 23, 1986 [JP] Japan ..... 61-253176

[51] Int. Cl.[4] ..... G03G 21/00

[52] U.S. Cl. ..... 355/246; 118/689

[58] Field of Search ..... 355/3 DD, 14 D, 246; 118/688, 689, 691

[56] References Cited

U.S. PATENT DOCUMENTS

| | | | |
|---|---|---|---|
| 3,778,146 | 12/1973 | Knapp | 118/691 X |
| 4,423,948 | 1/1984 | Kimura et al. | 355/14 D |
| 4,447,145 | 5/1984 | Snelling et al. | 355/14 D |
| 4,579,442 | 4/1986 | Minejima | 355/3 DD |
| 4,592,645 | 6/1986 | Kanai et al. | 118/689 X |
| 4,662,313 | 5/1987 | Jeromin et al. | 118/691 |
| 4,708,458 | 11/1987 | Ueda et al. | 355/3 DD |
| 4,711,551 | 12/1987 | Fujio et al. | 355/3 DD |

FOREIGN PATENT DOCUMENTS 56-148017 11/1981 Japan .

*Primary Examiner*—Fred L. Braun

*Attorney, Agent, or Firm*—Burns, Doane, Swecker & Mathis

[57] ABSTRACT

A developing apparatus which includes a toner replenishing device for replenishing toner into the developing apparatus, a toner concentration detecting sensor for generating an output coresponding to the toner amount in a developing material stirred and transported through the developing apparatus, with the output containing a varying output periodically produced and stable output, a discriminating element for deriving the stable output of the outputs from the toner concentration detecting element, and a comparator for outputting a feeding signal to the toner replenishing device through comparison between the output from the discriminating element and a preliminarily set reference value.

10 Claims, 12 Drawing Sheets

| ADDR. | e | d | c | b | a |
|---|---|---|---|---|---|
| SAMPLING DATA | Di5 | Di4 | Di3 | Di2 | Di1 |

⇩

| ADDR. | e | d | c | b | a |
|---|---|---|---|---|---|
| SAMPLING DATA | Di6 | Di5 | Di4 | Di3 | Di2 |

a.
b.
c. F. POS. SIG.
d. TM. SIG.
e. MAIN MO. (M1)
f. DEV. MO. (M2)
g. CHARGE (HV1)
h. TRANSF. (HV2)
i. SCAN. CL3
j. P. FEED CL2
k. TM. ROL. CL1
l. COPY FLAG.
m. TONER REP. MO. (M3)
n. ATDC SAMPLING
PRINT SW
Tf
Tc
Tb
Ta
Td
Te
Time

TONER CONCENTRATION CONTROL DEVICE FOR A DEVELOPING APPARATUS

The present invention generally relates to a developing apparatus to be used in an image forming arrangement such as a copying machine or the like, and more particularly, to a developing apparatus which employs a two or dual-component developing material including toner and carrier.

Conventionally, as one type of developing apparatus as referred to above, there have been provided various arrangements in which a developing material transport roller having transport vanes is disposed in a developing material transport passage formed at the rear face side of a developing material support member which confronts a photosensitive or photoreceptor drum so as to transport a dual-component developing material composed of toner and carrier along said transport passage as the developing material is being mixed and stirred, while part of the developing material is supplied onto the surface of the developing material support member for use in the developing.

In the developing apparatus of this kind, it is so arranged that, in order to achieve a stable image quality by successively replenishing toner in the amount corresponding to the toner to be consumed by the developing, a toner concentration detecting sensor is provided, with its sensor face being directed onto said developing material transport passage, so as to detect variation in the toner concentration of the developing material being transported as a variation in permeability, thereby to detect the toner concentration by the magnitude of the output of said detecting sensor.

However, since developing material transported over the sensor face has its level undulating, due to the fact that it is subjected to the mixing and stirring function as well as the transport function by the transport roller, the sensor output is not stabilized, and therefore, it is not clear on what detected value at which time point the toner concentration judgement is based, thus inviting such a problem that the obtained results can not be regarded as reflecting a true toner concentration at all times.

SUMMARY OF THE INVENTION

Accordingly, an essential object of the present invention is to provide an improved developing apparatus which is capable of providing a stable output of a toner concentration detecting sensor for efficient control of the toner concentration in the developing.

Another important object of the present invention is to provide a developing apparatus of the above described type which is simple in construction and stable in functioning.

In accomplishing these and other objects, according to one preferred embodiment of the present invention, there is provided a developing apparatus which includes a toner replenishing means for replenishing toner into the developing apparatus, a toner concentration detecting means for generating an output corresponding to the toner amount in a developing material stirred and transported through the developing apparatus, with said output containing a varying output periodically produced and a stable output, a discriminating means for deriving the stable output of the outputs from said toner concentration detecting means, and a comparing means for outputting a feeding signal to said toner replenishing means through comparison between the output from said discriminating means and a preliminarily set reference value.

By the arrangement according to the present invention as described above, an improved developing apparatus has been advantageously presented.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1A:
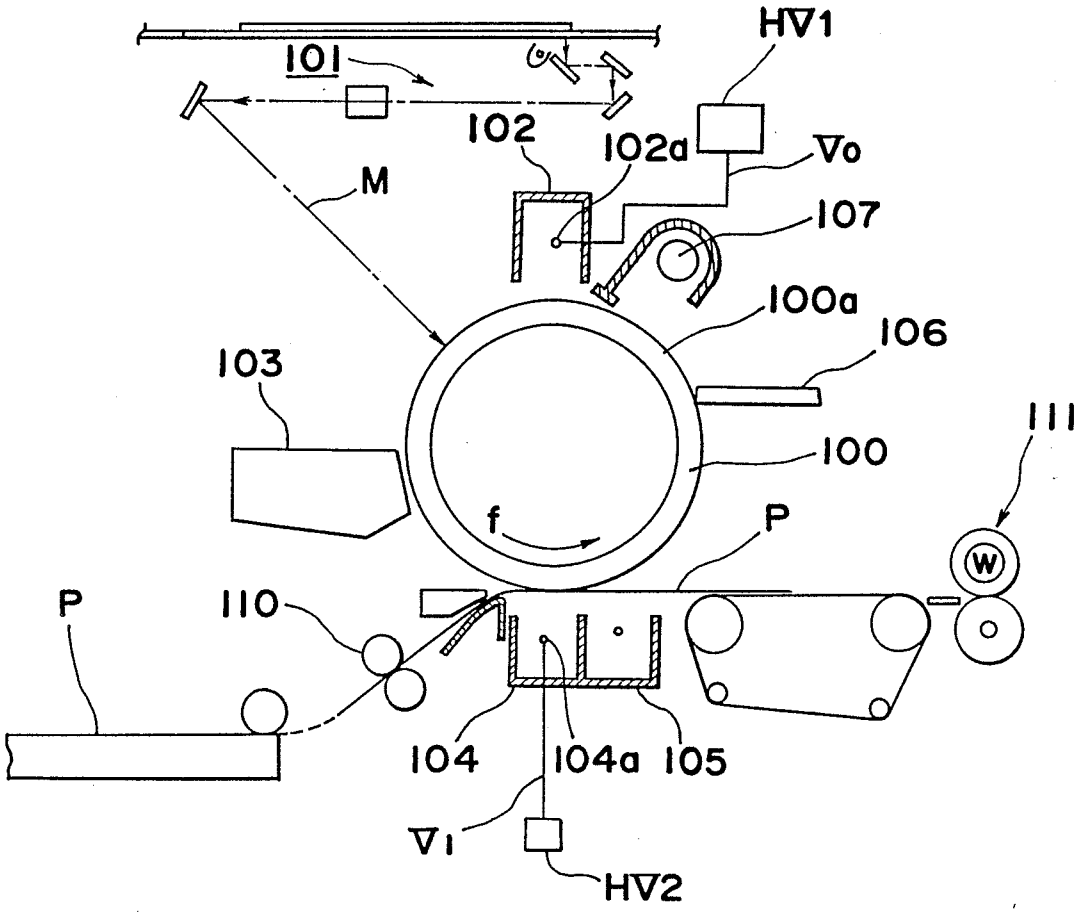
FIG. 1(A) is a schematic side sectional view showing a main portion of an image forming apparatus or electrophotographic copying machine to which an improved developing apparatus according to the present invention may be applied.

Before the description of the present invention proceeds, it is to be noted that like parts are designated by like reference numerals throughout the accompanying drawings.

Referring now to the drawings, there is shown in FIG. 1(A) the main portion of an image forming apparatus or electrophotographic copying machine to which a developing apparatus according to the present invention may be applied.

Figure 7:
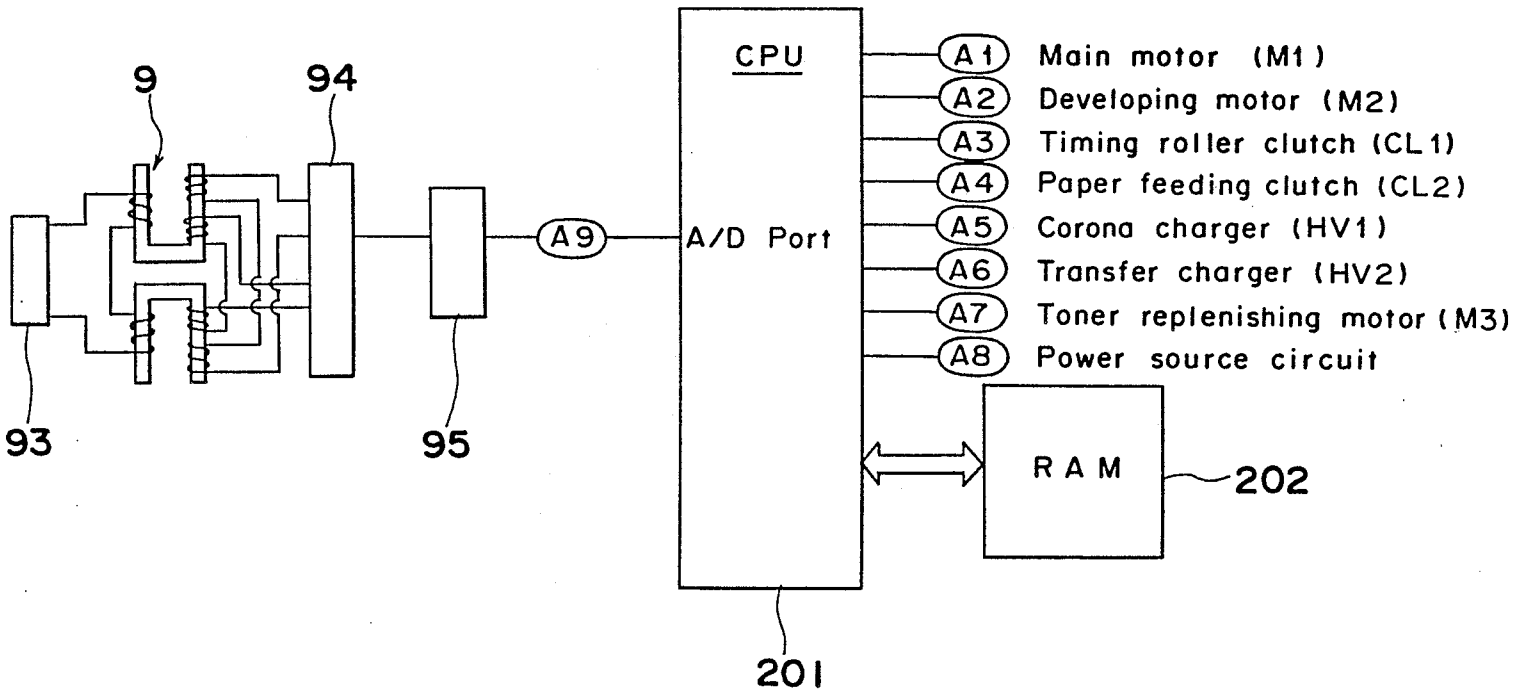
FIG. 7 is a block diagram showing part of the circuit construction for a control mechanism of the copying apparatus provided with the developing apparatus of FIG. 2.

In FIG. 1(A), generally at the central portion of the copying machine, there is rotatably provided a photosensitive drum or photoreceptor drum 100 so as to be driven for rotation counterclockwise as indicated by an arrow f. Around said drum 100, there are sequentially disposed various components or processing stations such as a charging unit or corona charger 102, a developing unit 103 directly related to the present invention, a transfer unit 104, a separating unit 105, a cleaner 106 and an eraser lamp 107. These components referred to above are in a specified arrangement, and sequentially controlled by a micro-computer (hereinafter referred to as "CPU") 201 to be described later (FIG. 7).

The photosensitive drum 1 is drivingly rotated counterclockwise at a system speed of S mm/s. When the CPU 201 starts up a high-voltage unit HV1, a high voltage charging output Vo is applied to a wire electrode 102*a* of the charging unit 102, which in turn uniformly charges the photosensitive surface 100*a* of the drum 100. The surface 100*a* of the drum 100 is exposed to light M having image data through an optical system 101, whereby an electrostatic latent image is formed on said surface 100*a* of the drum 100. The latent image is then converted to a toner image by the developing unit 103. The toner image is transferred by the transfer unit 104 onto paper P which is transported at the system speed S mm/s by being forwarded by a timing roller 110 driven in timed relation with the exposure of the drum 100. More specifically, the CPU 201 causes a high-voltage unit HV2 to apply a high voltage V1 to a wire electrode 104*a* of the transfer unit 104, which produces static electricity for attracting the toner image onto the paper P. The paper P bearing the transferred toner image thereon is separated from the drum 100 by the separating unit 105, and thereafter is conveyed to a fixing device 111 where the toner is fixed to the paper P. On the other hand, the toner remaining on the surface 100*a* of the drum 100 is scraped off by the cleaner 106. The residual charges are erased by being illuminated by the eraser lamp 107. The image forming cycle as described above is repeated.

Figure 1B:
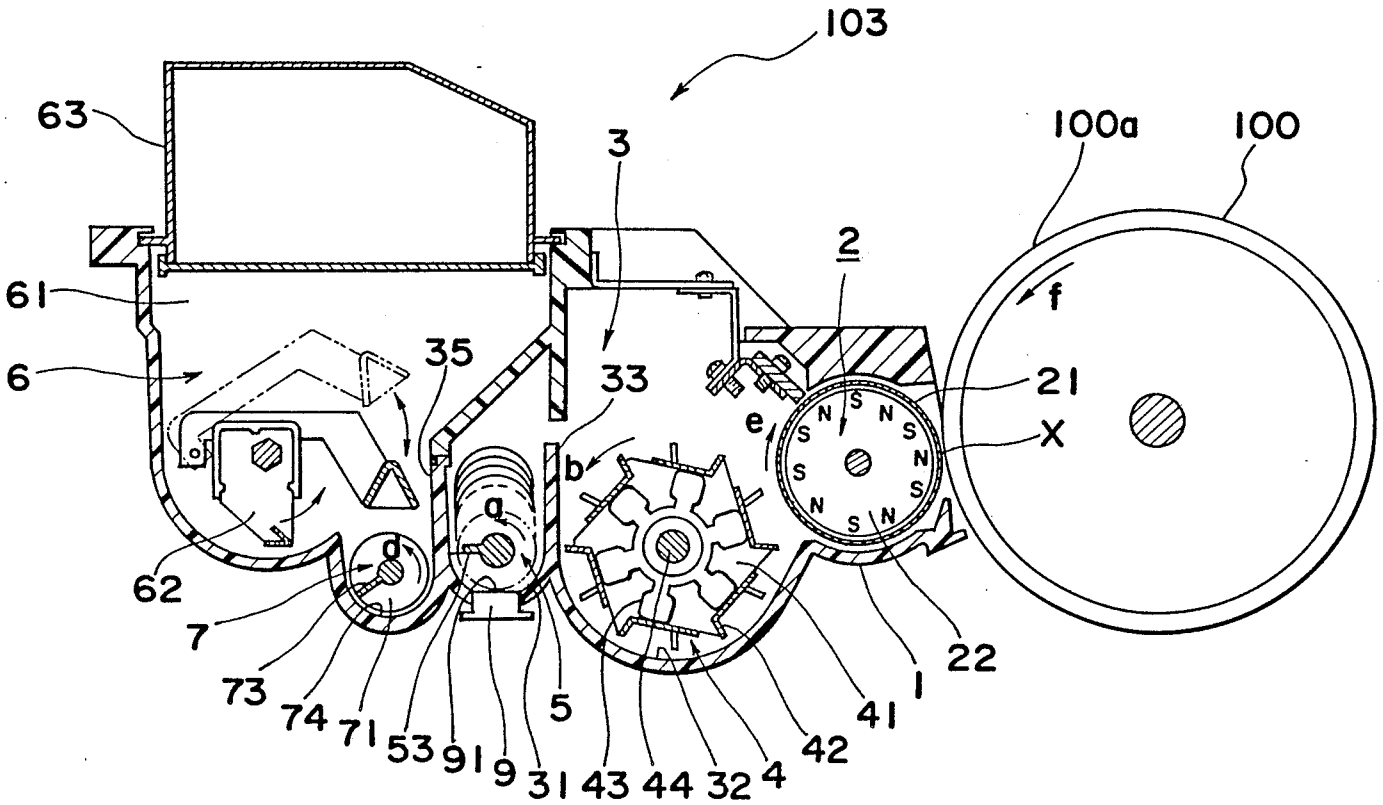
FIG. 1(B) is a schematic side sectional view showing, on an enlarged scale, a developing apparatus according to one preferred embodiment of the present invention, and its positional relation with respect to a photoreceptor drum.
Figure 2:
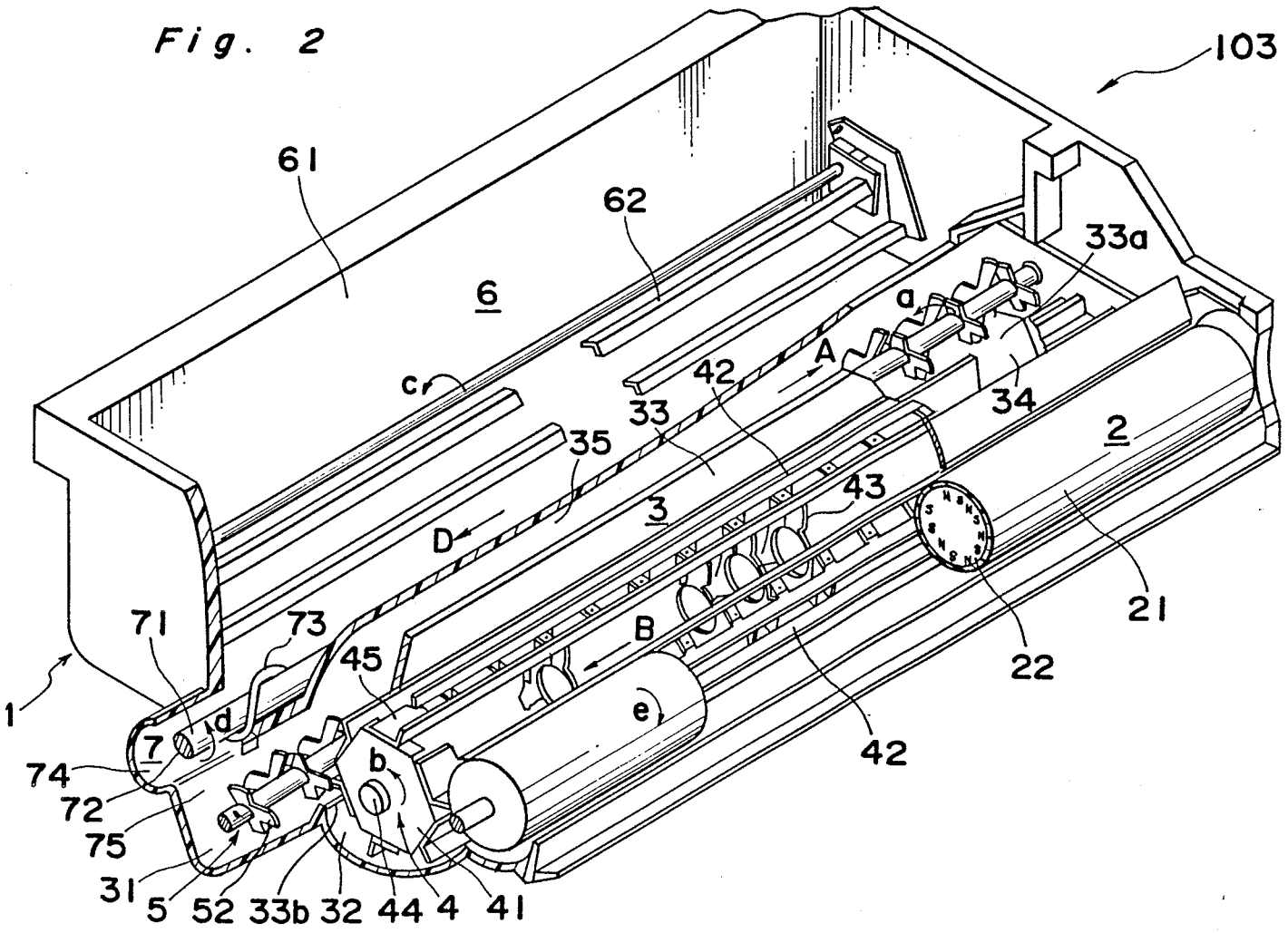
FIG. 2 is a fragmentary perspective view, partly broken away, of the developing apparatus of FIG. 1.

In FIGS. 1(B) and 2, there is shown on an enlarged scale, the improved developing apparatus 103 according to one preferred embodiment of the present invention, which generally includes essential portions as follows contained in a casing 1 thereof.

(a) a developing section 2, (b) a developing material circulation/transport section 3, (c) a toner accommodating section 6, and (d) a toner replenishing section 7.

The developing apparatus 103 is so arranged that, while circulating and transporting a two or dual-component developing material composed of toner and carrier by the developing material circulation/transport section 3 (referred to merely as transport section 3 hereinafter), it supplies part of the developing material to the developing section 2 for the development, and replenishes toner corresponding in amount to the consumed toner, to the transport section 3 from the toner accommodating section 6 through the toner replenishing section 7.

Subsequently, constructions of the respective sections will be described hereinbelow.

(a) Developing section 2

The developing section 2 includes a developing sleeve 21 made of a non-magnetic electrically conductive material (e.g. aluminum) in a cylindrical shape in which a magnet roller 22 is incorporated, and formed, on its outer peripheral face, with very small convex and concave portions or undulation, for example, by blasting finish, and is rotatably disposed to confront the photosensitive surface 100*a* of the photoreceptor drum 100 for rotation in a direction indicated by an arrow e as shown.

(b) Transport section 3

The transport section 3 includes a developing material mixing and stirring transport passage 31 and a developing material supply transport passage 32 which are formed by curving the bottom portion of the casing 1 and communicated with each other through paths 33*a* and 33*b* formed at opposite ends of a partition plate 33 rising from the bottom portion of the casing 1 (FIG. 2).

The transport passage 32 is directed in a parallel relation to the developing sleeve 21, and accommodates a bucket roller 4 therein.

The bucket roller 4 includes a pair of spaced support plates 41 in a hexagonal shape (only one support plate 41 is shown), a plurality of beams or bucket plates 42 bridging respective corresponding sides of the support plates 41, a large number of blades or vanes 43 provided inside the buckets 42, and a support shaft 44 extending through the interior of the roller 4 for rotation of said bucket roller 4 in a direction indicated by an arrow b.

Figure 3:
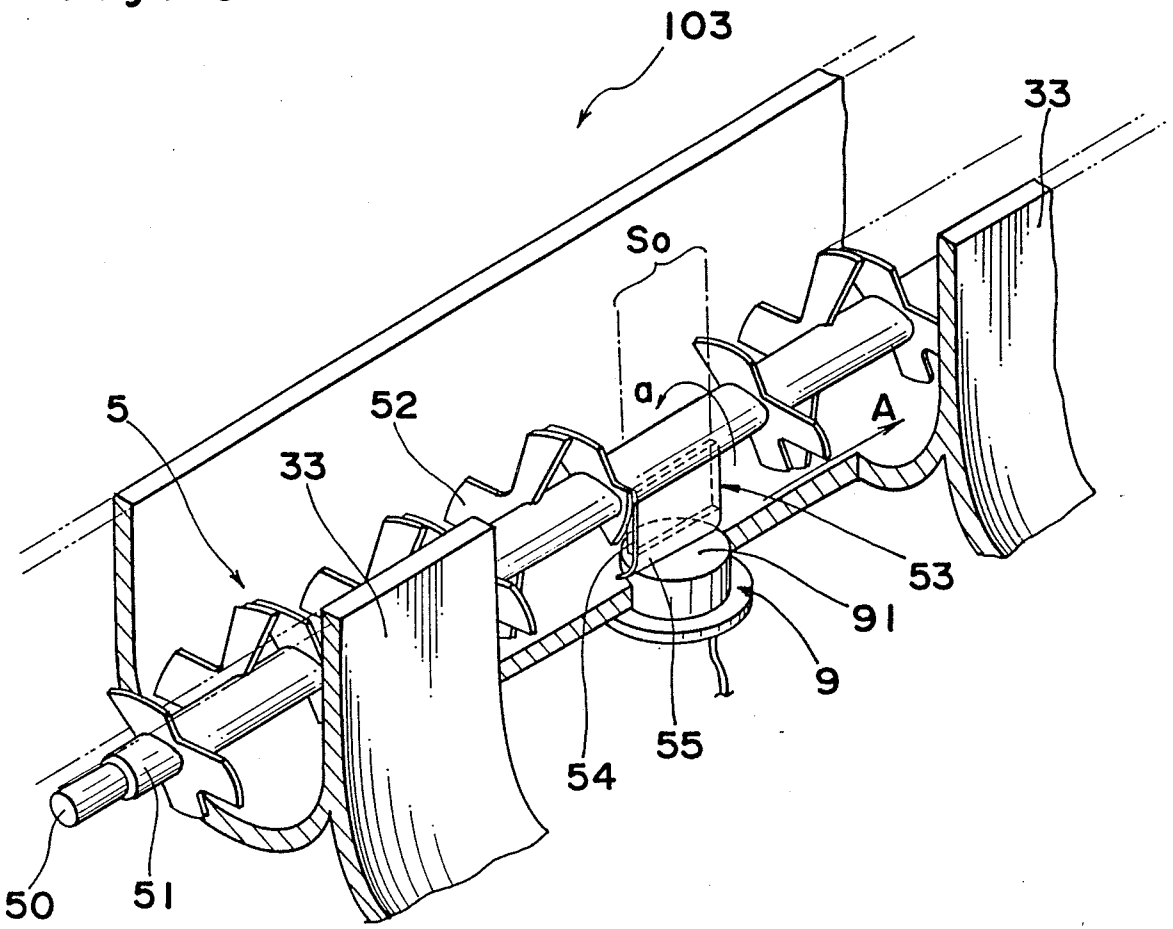
FIG. 3 is also a fragmentary perspective view of the developing apparatus of FIG. 1, particularly showing a developing material transport roller or screw roller and a toner concentration detecting sensor employed therein.

The other transport passage 31 is adapted to be slightly inclined so as to be lower than the transport passage 32 at the left side, but higher than said passage 32 at the right side in FIG. 2. Generally, at the central bottom portion of the transport passage 31, there is mounted a toner concentration detecting sensor 9 which is a magnetic sensor as also shown in FIG. 3, and the upper surface 91 of said sensor 9 is arranged to lie on generally the same plane as inner surface of the transport passage 31 so as not to obstruct a smooth flow of the developing material transported through the transport passage 31.

It is to be noted here that the toner concentration detecting sensor 9 is intended to detect the concentration of the toner contained in the developing material transported through the transport passage 31, as a variation of permeability, and the sensor output thereof is arranged to be applied to a control device to be described later.

Figure 4:
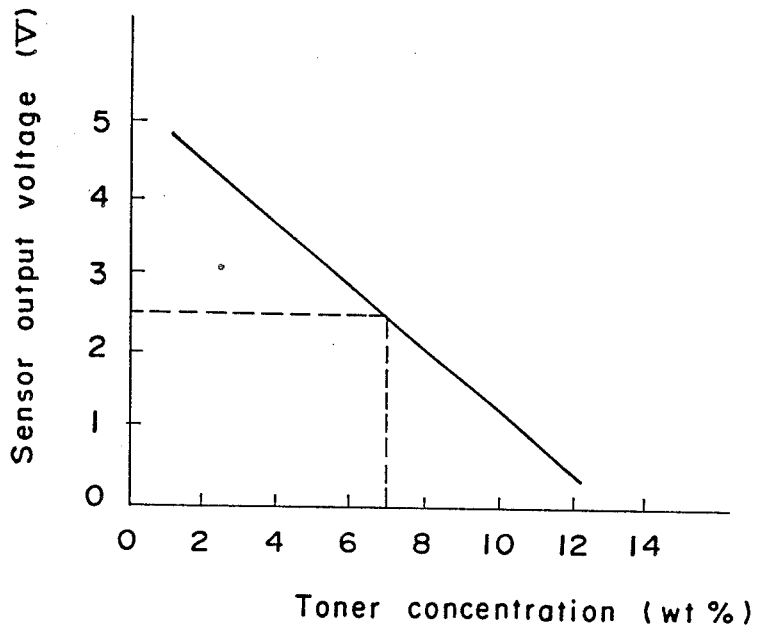
FIG. 4 is a graph showing the toner concentration versus sensor output characteristics of the toner concentration sensor.

Incidentally, the sensor characteristic of the toner concentration detecting sensor 9, i.e. toner concentration (Wt%) Vs. sensor output voltage (V) characteristic is set in a relation as shown in FIG. 4, and in the present embodiment, the reference concentration as a judging standard is set to be 7.0 Wt %, with the corresponding sensor output voltage being set at 2.5 V.

Moreover, in the transport passage 31, there is rotatably mounted a developing material transport roller 5(referred to merely as a transport roller 5 hereinafter) for rotation at a constant period (300 m sec.) in a direction indicated by an arrow a.

As is most clearly seen in FIG. 3, the transport roller 5 includes a support shaft 50 and a blade member 51 fixedly mounted thereon, and said blade member 51 is fitted with a large number of transport vanes 52 except for its portion corresponding to a toner concentration detecting area So at which the upper sensor surface 91 of the toner concentration detecting sensor 9 is located. At the above portion corresponding to the detecting area So, a developing material exchanging means 53 is provided instead of the transport vanes 52.

The developing material exchanging means 53 referred to above includes a scrape-up member 54 integrally attached to the blade member 51 in the axial direction, and a cleaning member 55, for example, of polyester film of 0.05 mm in thickness fixed to said scrape-up member 54.

Figure 5:
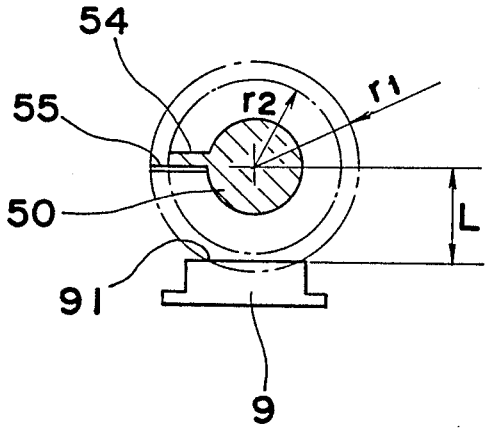
FIG. 5 is a cross sectional view showing the configuration of a developing material exchanging means employed in the arrangement of FIG. 2.

As shown in FIG. 5, dimensions at respective portions are set in such relation as r1>L>r2, where L represents a distance between the center of the support shaft 50 and the upper sensor surface 91, r1 denotes a distance between the center of the shaft 50 and the forward end of the cleaning member 55, and r2 shows a distance between the center of the shaft 50 and a forward end of the scrape-up member 54.

By the above setting, as the transport roller 5 rotates, the cleaning member 55 rubs against the upper sensor surface 91, thereby preventing toner from adhering to the sensor surface 91.

(c)Toner accommodating section 6

The toner accommodating section 6 includes a replenishing toner hopper 61 formed by partitioning the casing 1 at the rear portion of the transport passage 31, a stirring device 62 provided in the toner hopper 61, and a tone cartridge 63 preliminarily filled with replenishing toner and detachably mounted on the toner hopper 61 for supplying the replenishing toner into the hopper 61.

(d) Toner replenishing section 7

The toner replenishing section 7 is provided between the transport passage 31 and the toner accommodating section 6, and is separated from said passage 31 by a partition wall 35.

In the toner replenishing section 7, there is provided a replenishing roller 71, which includes a support shaft 72 and a transport blade 73 spirally wound around said shaft 72, and is rotatably provided in a replenishing passage 74 located at the bottom portion of the hopper 61 for rotation in the direction of an arrow d. As shown in FIG. 2, the replenishing passage 74 is communicated, at its left side, with said transport passage 31 through a toner replenishing inclined surface 75, which has an angle equal to or larger than an angle of repose for toner so as to facilitate flow of the toner.

Hereinbelow, movement of the developing material in the developing apparatus of the present invention having the construction as described so far will be explained.

The toner replenished into the toner hopper 61 of the toner accommodating section 6 is transported through the replenishing passage 74 in the direction of the arrow D based on the rotation of the replenishing roller 71 in the direction of the arrow d, while being agitated by the stirring device 62, and is fed to an upstream side of the transport passage 31 as it is guided by the inclined face 75 shown at the left side in FIG. 2.

The toner thus fed to the transport passage 31 is transported through said passage 31 in the direction of the arrow A by the transport vanes 52 based on the rotation of the transport roller 5, together with the developing material fed from the neighboring passage 32 via the path 33*b*, and passes through the toner concentration detecting region So located approximately at the central portion so as to be transported to the inner side end portion (FIG. 3).

The developing material transported to the toner concentration detecting region So is raised in the direction of the arrow a based on the rotation of the pick-up member 54 and the cleaning member 55 of the developing material exchanging means, and upon arrival at a predetermined level, spontaneously falls onto the sensor surface 91, and thus, smoothly passes through the region So without staying thereat, owing to depression by the developing material successively fed, and also based on the scraping function of the transport vanes 52 located at the downstream side of the region So.

The developing material which has reached the inner side end portion of the transport passage 31 through the toner concentration detecting region So, is displaced into the transport passage 32 from the path 33*a* as it is guided by the inclined surface 34. The developing material thus fed into the transport passage 32 is transported by the vanes 43 in the direction of the arrow B, based on the rotation of the bucket roller 4 in the direction of the arrow b, and upon arrival at the forward side end portion, is again fed into the passage 31 by a scoop-up plate 45 (FIG. 2) so as to be transported in the direction of the arrow A within the transport passage 31.

It is to be noted here that, during transportation through the transport passage 32, part of the developing material is scooped up by the buckets 42 so as to be supplied onto the outer surface of the developing sleeve 21.

The developing material thus supplied onto the outer peripheral surface of the developing sleeve 21 is held thereon along the magnetic lines of force of the magnet roller 22 in a state of a magnetic brush, while it is transported in the same direction based on the rotation of the developing sleeve 21 in the direction of the arrow e, and rubs against an electrostatic latent image formed on the photosensitive surface 100*a* of the photoreceptor drum 100 at a developing region X (FIG. 1(B)) for developing the latent image into a visible toner image.

Meanwhile, the developing material which has passed through the developing region X is further transported over the developing sleeve 21 in the direction of the arrow e, and upon arrival at the portion confronting the bucket roller 4 where the neighboring magnetic poles of the same polarity (S pole) form a repelling magnetic field, is disengaged from the surface of the magnetic sleeve 21 and taken into the developing material in the transport passage 32 so as to be again transported in the direction of the arrow b.

Figure 6:
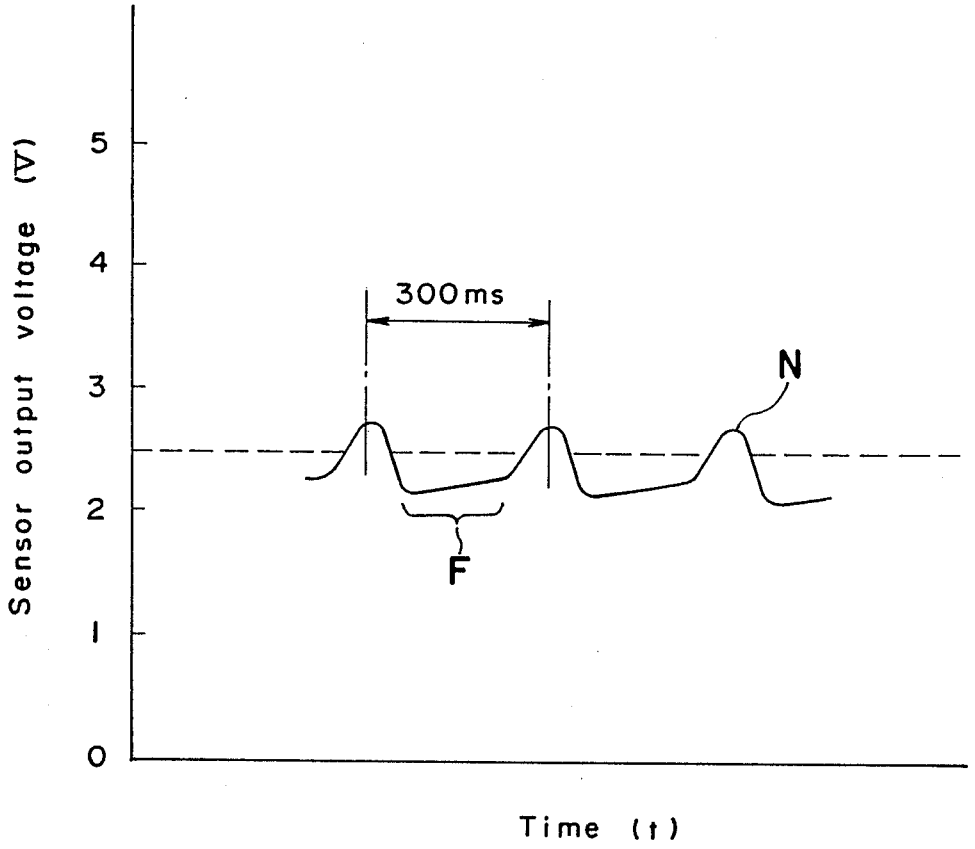
FIG. 6 is a diagram showing output waveforms of the toner concentration detecting sensor.

Incidentally, in the toner concentration detecting sensor 9, the sensor surface 91 is periodically cleaned by the cleaning member 55, and in that case, since the developing material is increased in its density as it is depressed onto the sensor surface 91 by the cleaning member 55, noises N in the peak form periodically appear in the sensor output waveforms as shown in FIG. 6. However, owing to the fact that, since the toner is accumulated on the sensor surface 91 in a natural state, between the noises N, the output waveforms form a comparatively flat stable region F.

Therefore, in order to detect the toner concentration of the developing material, it is necessary to sample the sensor output in said stable region F, and for this purpose, a toner concentration detecting mechanism as described hereinbelow is provided.

Toner concentration control

Hereinbelow, the toner concentration control mechanism and its functioning will be described together with the general operation of the copying apparatus provided with the developing apparatus according to the present invention.

In FIG. 7 showing part of the circuit construction of a control circuit for the copying apparatus provided with the developing apparatus according to the present invention, there is provided the CPU (central processing unit) 201 coupled with the toner concentration detecting sensor 9 through a terminal A9, and having output terminals A1, A2, A3, A4, A5, A6 and A7 which are respectively connected to driving switch transistors (not shown) of a main motor M1 for driving the photoreceptor drum, a developing motor M2 for driving the developing sleeve, a timing roller clutch CL1, a paper feeding clutch CL2, a corona charger HV1, a transfer charger HV2, and a toner replenishing motor M3, and another output terminal A8 connected to a power source circuit (not shown). A RAM 202 backed up by a battery is connected to the CPU 201 through a data bus.

The toner concentration detecting sensor 9 is intended to detect magnetic permeability in the developing material based on a signal outputted from an oscillator 93, and arranged to replace variation of the magnetic permeability by inductance variation of a coil so as to output the signal thereof to a phase comparator 94, which applies said signal to an A/D port of the CPU 201 in the form of an analog signal shown in FIG. 6 via a capacitor 95 through the terminal A9. The inputted sensor output signal is converted into a digital signal by an A/D converter (not shown) so as to be stored in said RAM 202 and properly taken out therefrom for being subjected to data processing.

Subsequently, processing procedures of the control circuit will be described.

(i) Main routine

Figure 8:
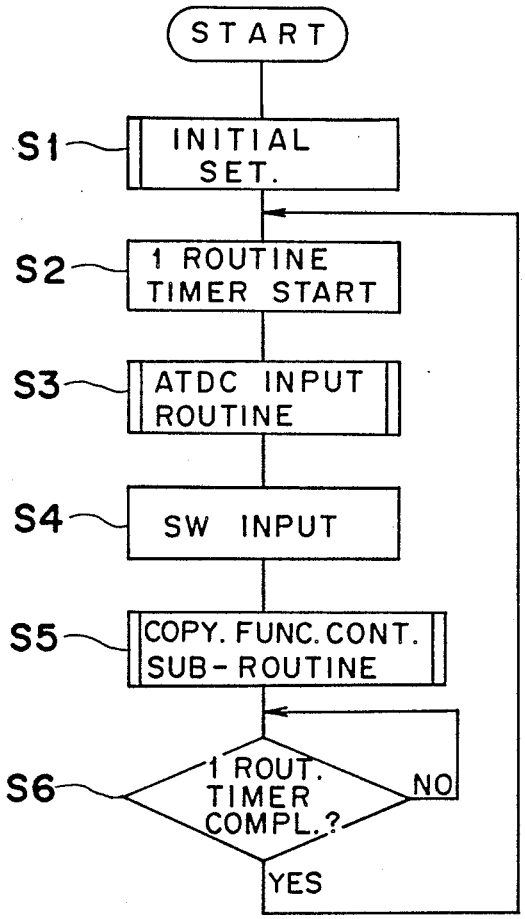
FIG. 8 is a flow-chart for a main routine of the developing apparatus of FIG. 2.

In a flow-chart of FIG. 8 for a main routine showing the processing procedures of the copying apparatus on the whole, upon turning on the power source, the control device is initialized at step S1, and 1-routine timer is started at step S2, thereby to execute the processing of the main routine at each set time (per 10 m sec. in the present embodiment).

In the subsequent step S3, ATDC input routine is executed.

The ATDC input routine is the process for detecting the toner concentration of the developing material based on the sampling data in the stable region F of the output waveform shown in FIG. 6 according to the signal applied from the toner concentration detecting sensor 9 to the CPU 201, and details of said process will be described later.

Thereafter, at Step S4, input of various switches is effected.

In the subsequent step S5, a copying function control routine is executed. This routine relates to a process in which the copying function is executed by driving the main motor M1, etc. according to a time-chart shown in FIG. 13, while toner is supplied to the developing apparatus based on the result of detection of the toner concentration obtained by said ATDC routine.

At step S6, it is judged whether or not the 1-routine timer set at step S2 is completed, and if it is completed, the procedure returns to step S2 again so as to start the 1-routine timer once more.

Figure 9:
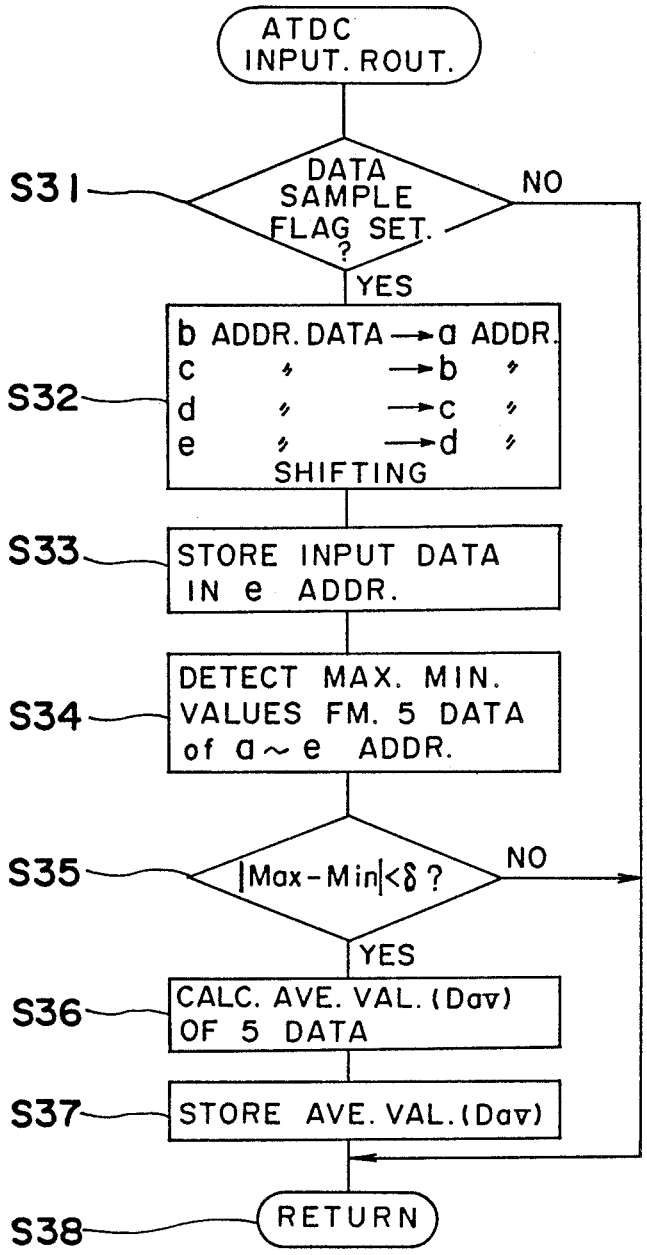
FIG. 9 is a flow-chart for ATDC input routine.

(ii) ATDC input routine (FIG. 9)(discriminating means)

This routine is intended to detect the toner concentration at the stable region F on the basis of five continuous sensor output sampling data applied from the toner concentration detecting sensor 9 to the CPU 201 and further converted into the digital signal per each 1-routine timer (10 m sec.).

In the first place, at step S31, it is checked whether or not a flag for sampling the data from the sensor output is set.

Figure 13:
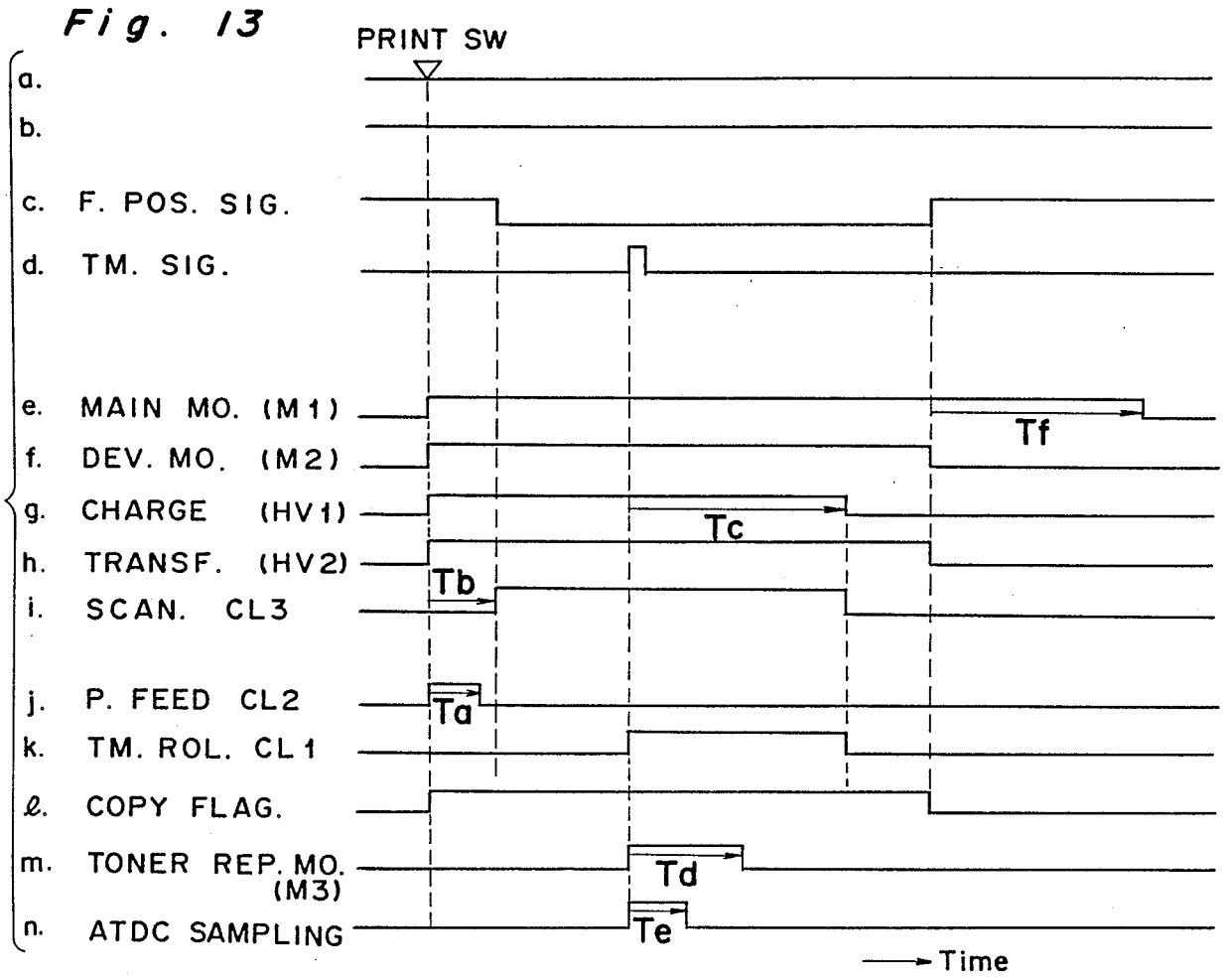
FIG. 13 is a timing chart showing the control state of the copying machine.

More specifically, in the series of the copying functions shown in FIG. 13, it is judged whether or not the flag is set at the data sampling time.

If the flag has been set, the step proceeds to step S32, while on the contrary, if the flag has not been set, the procedure jumps to step S38 without effecting subsequent steps for returning to the main routine.

Figures 10, 11:
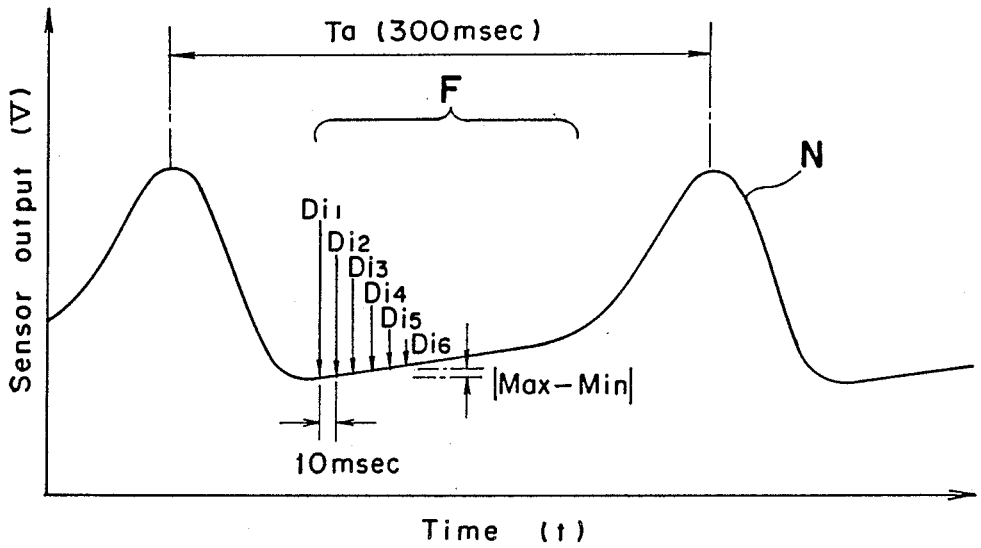
FIG. 10 is a diagram showing the state of exchange of sampling data.
FIG. 11 is a graphical diagram showing the method for data sampling.

As shown in FIG. 10, at step S32, sampling data Di1~Di5 (FIG. 11) stored in the addresses are of the RAM 202 are successively called out, and sampling data Di2~Di5 stored in the addresses b, c, d and e are respectively moved into the addresses a, b, c and d.

Then, at Step S33, as shown in FIG. 11, a fresh sampling data Di6 inputted to the CPU 201 from the sensor 9 after 1-routine timer (10 m sec.) and further subjected to A/D conversion is memorized in the address e.

Subsequently, at step S34 (first calculating means), maximum value Max. and minimum value Min. are detected from the five sampling data Di2 to Di6 stored in the addresses a to e to judge whether or not a difference therebetween represented by |Max-Min| is within a reference value $\delta$ at step S35 second calculating means. It is to be noted that, in the present embodiment, the reference value $\delta$ is set at 0.05 V.

In the case where the relation is $|\text{Max-Min}| < \delta$, it is judged that the sampling data Di2 to Di6 are those derived from the stable region F. On the contrary, if the relation is $|\text{Max-Min}| > \delta$, the data Di2 to Di6 are found to be those derived from the noise N portion.

Thus, if the relation is |Max-Min| < reference value $\delta$, i.e. if the sampling data are those from the stable region F, the procedure proceeds to step S36, while on the contrary, if the sampling data are those from the noise N portion, the procedure jumps to step S38 without effecting the subsequent steps S36 and S37 for returning to the main routine.

At step S36, the average value Dav of the five sampling data Di2 to Di6 for the addresses a to e is calculated, and at subsequent Step S37, a fresh average value Dav is stored in the RAM 202 to replace the old value, so as to return to the main routine at Step S38.

(iii) Copying function control routine

Figure 12:
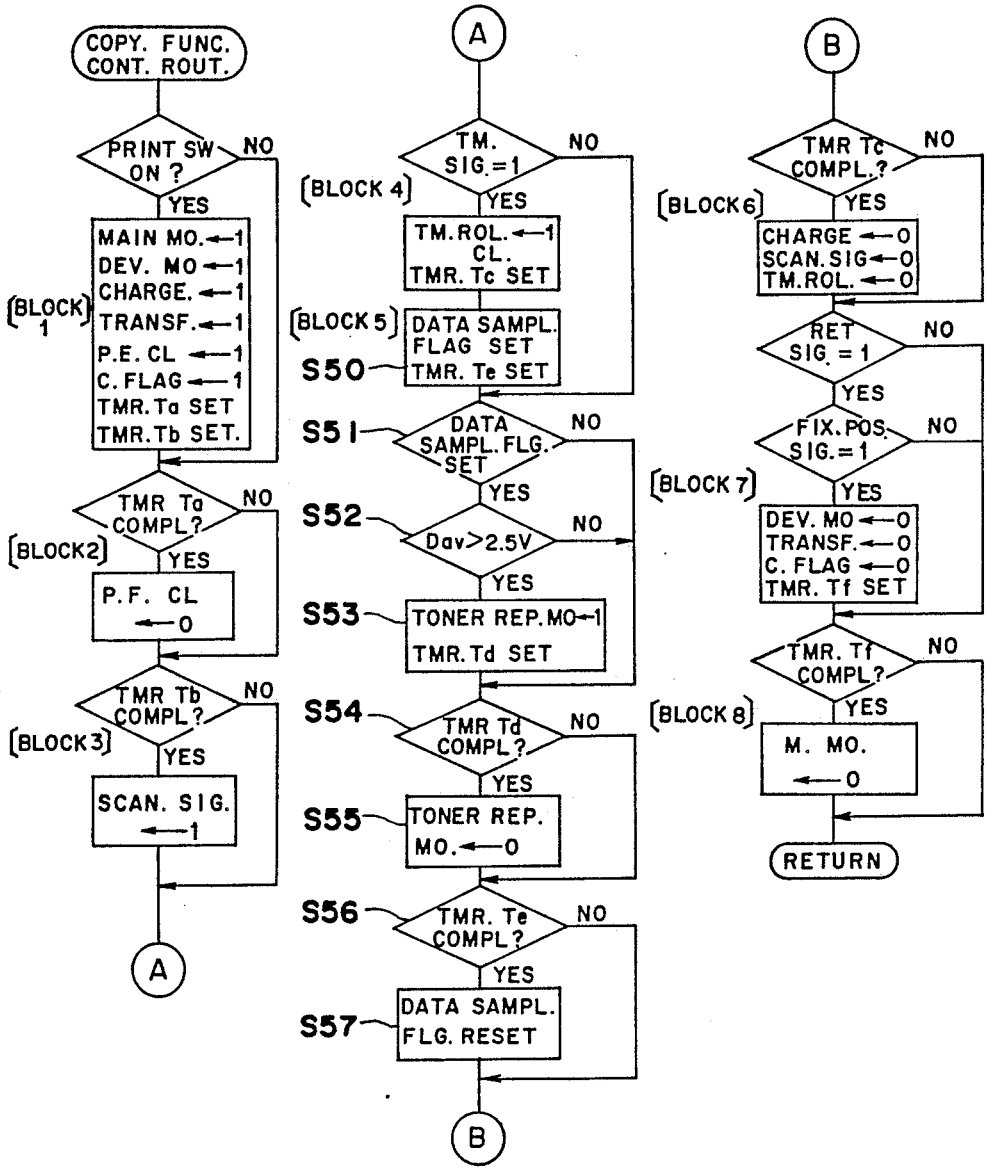
FIG. 12 is a flow-chart showing the copying operation control routine.

This routine shown in FIG. 12 is the process which controls the copying function, and also executes the toner replenishing function. The timing-chart in FIG. 13 represents the state of functioning at essential portions of the copying apparatus.

At Block 1 in FIG. 12, upon turning on of a print SW, the main motor M1 for driving the photoreceptor drum 100, developing motor M2 for driving the developing device, corona charger HV1, transfer charger HV2, paper feeding clutch CL2 are respectively caused to function, while copy flag indicating that the copying function is under way is set to "1", with the timers Ta and Tb for the control being started.

At Block 2, completion of said timer Ta is judged so as to turn off the paper feeding clutch.

At Block 3, the timer Tb is checked for completion, thereby to turn on the scan clutch CL3 of the scan motor for driving the scanning optical system for starting the scanning function.

At Block 4, the timing roller clutch CL1 is turned on upon output of a timing signal owing to actuation of the timing switch during the scanning operation, and also, processing to set the timer Tc is effected, while the copy paper sheet is transported in synchronization with the image formed on the surface of the photoreceptor drum 100.

Meanwhile, Block 5 represents a process for executing the toner replenishing function.

In the first place, at Step S50, data sampling flag and a timer Te for the data sampling are set. It is to be noted here that in the present embodiment, the timer Te is set at 300 m sec., which value is in agreement with the period in which the screw roller 5 is rotated, and also that, since 1-routine timer is set at 10 m sec. as described earlier, 30 pieces of data are to be sampled during the time.

At Step S51, it is checked whether or not the data sampling flag is set, and if it is set, the procedure proceeds to the next Step S52, while if it is not set, the step jumps to Step S54.

Thus, at Step S52, judgement is made as to whether or not the sensor output average value Dav for the stable region F as calculated by ATDC input routine is above 2.5 V.

If it is judged that the relation is sensor output average value (Dav)>2.5 V, i.e. the toner concentration is below the reference concentration, the toner is insufficient, and therefore, the procedure proceeds to the next Step S53 to effect toner replenishment.

On the other hand, if the relation is not found to be sensor output average value (Dav)>2.5 V, i.e. the toner concentration is above the reference concentration, sufficient amount of the toner is present, without necessity for toner replenishment, and the procedure proceeds to Step S54.

At Step S53, the toner replenishing motor M3 is started to supply the toner within the toner hopper 61 into the transport passage 31, and simultaneously, the timer Td for the driving time of the toner replenishing motor M3 is started.

Subsequently, at Step S54, judgement is made as to whether or not the timer Td is completed, and if it is completed, the toner replenishing motor M3 is stopped at step S55, while if it is not completed, the procedure proceeds to Step S56.

At Step S56, it is checked whether or not the data sampling timer Te is completed, and if said timer is completed, data sampling flag is reset at Step S57, while if it is not completed, the procedure proceeds to the next Block 6 in the state as it is.

In Block 6, the timer Tc is checked for completion, and if it is, the corona charger HV1, scanning clutch CL3 and timing roller clutch CL1 are respectively turned off. It is to be noted here that the timer Tc may be set as variable according to sizes of the copy paper sheets, etc.

In Block 7, when a fixed position switch (not shown) is turned on upon restoration of the optical system back to the fixed position following the returning function, the developing motor M2, and transfer charger HV2 are respectively turned off, and with the copy flag set to "0", the processing to set the timer Tf is effected.

In Block 8, the timer Tf is checked for completion, and if it is, the main motor is turned off to return to the main routine.

As is clear from the foregoing description, according to the developing apparatus of the present invention, there are provided the developing material exchanging means for periodically exchanging the developing material on the surface of said detecting sensor, and the toner concentration detecting mechanism or discriminator for reading the output data of the toner concentration detecting sensor only when the output of the detecting sensor is stabilized.

Accordingly, although the output signal of the toner concentration detecting sensor is periodically varied as it is affected by the developing material exchanging means, the signal waveform thereof is stabilized as a whole. Moreover, since the output at the stable region of the output waveform accurately reflects the actual toner concentration, and the toner concentration is detected from the output value at this portion by the discriminator, it is possible to correctly measure the toner concentration of the developing material.

Accordingly, the toner concentration of the developing material can be maintained at a proper value to obtain images at a high quality under a stable state. Furthermore, soiling within the apparatus due to excessive toner can be prevented for maintaining favorable circumstances.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed:

1. A developing apparatus which comprises toner replenishing means for replenishing toner into the developing apparatus, toner concentration detecting means for generating an output corresponding to the toner amount in a developing material stirred and transported through the developing apparatus, said output having varying output levels with a portion where said varying level is within a predetermined range, discriminating means for deriving said portion where said varying level is within a predetermined range, and comparing means for outputting a feeding signal to said toner replenishing means through comparison between the output from said discriminating means and a preliminarily set reference value.

2. A developing apparatus as claimed in claim 1, wherein said toner concentration detecting means is arranged to magnetically detect the toner concentration in the developing material.

3. A developing apparatus as claimed in claim 1, wherein said discriminating means includes means for memorizing the output from said toner concentration detecting means at predetermined times, and means for judging whether or not a difference between an uppermost value and a lowermost value of a predetermined number of the memorized values is within an allowable range.

4. A developing apparatus as claimed in claim 1, wherein said portion within said predetermined range is produced periodically.

5. A developing apparatus as claimed in claim 4, wherein said toner concentration detecting means is arranged to magnetically detect the toner concentration in the developing material.

6. A developing apparatus as claimed in claim 4, wherein said discriminating means includes means for memorizing the output from said toner concentration detecting means at predetermined times, and means for judging whether or not a difference between an uppermost value and a lowermost value of the memorized values in a predetermined time is within an allowable range.

7. A developing apparatus which comprises a toner replenishing means for replenishing toner into the developing apparatus, toner concentration detecting means for generating an output corresponding to the toner amount in a developing material within said developing apparatus, means for memorizing the output from said detecting means at predetermined times, first calculating means for calculating a difference between maximum and minimum values of the predetermined number of memorized values, second calculating means for calculating an average of each memorized detection value when said difference obtained by said first calculating means is within the predetermined allowable range, and comparing means for outputting a feeding signal to said toner replenishing means through comparison between the average value obtained by said second calculating means and a preset reference value.

8. A developing apparatus which comprises toner replenishing means for replenishing toner into the developing apparatus, toner concentration detecting means for generating an output corresponding to the toner amount in a developing material stirred and transported through the developing apparatus, said output containing varying output levels, discriminating means for deriving a portion of the output where the output level variation in a predetermined time is smaller than a predetermined amount, and comparing means for outputting a feeding signal to said toner replenishing means through comparison between the output from said discriminating means and a preliminarily set reference value.

9. A developing apparatus as claimed in claim 8, wherein said portion in said predetermined time is smaller than predetermined amount is produced periodically.

10. In a developing apparatus which comprises a developing material transport passage, developing material transport means having transport vanes and toner concentration detecting sensor provided on said developing material transport passage so as to detect the toner concentration as the developing material is transported along said transport passage for control of the toner concentration, developing material exchanging means for periodically exchanging the developing material on the surface of said detecting sensor, discriminating means for discriminating a portion of the output generated by said detecting sensor where the output level variation in a predetermined time is smaller than a predetermined amount, and toner concentration detecting mechanism for detecting the toner concentration based on the portion of the output data of said toner detecting sensor that said discriminating means has discriminated.

* * * * *